United States Patent [19]

Plocek et al.

[11] Patent Number: 5,071,374

[45] Date of Patent: Dec. 10, 1991

[54] FLOATABLE ELECTRICAL CONNECTOR WITH TERMINAL POSITION ASSURANCE COMPONENT

[75] Inventors: Edward Plocek, Lisle; Bill Wilson, Montgomery; Thomas Premo, West Chicago, all of Ill.

[73] Assignee: Molex Incorporated, Lisle, Ill.

[21] Appl. No.: 587,832

[22] Filed: Sep. 24, 1990

[51] Int. Cl.[5] ..... H01R 13/514

[52] U.S. Cl. ..... 439/752; 439/247; 439/595

[58] Field of Search ..... 439/247-249, 439/595, 752

[56] References Cited

U.S. PATENT DOCUMENTS

| | | | |
|---|---|---|---|
| 4,824,387 | 4/1989 | De Jong et al. | 439/248 |
| 4,900,271 | 2/1990 | Colleran et al. | 439/595 |
| 4,946,398 | 8/1990 | Takenouchi et al. | 439/752 X |

*Primary Examiner*—Eugene F. Desmond

*Attorney, Agent, or Firm*—Louis A. Hecht; Stephen Z. Weiss; A. A. Tirva

[57] ABSTRACT

An electrical connector is provided for floatable mounting to a panel. The connector includes a plurality of centering beams for engaging edge regions of a mounting aperture in a panel and for exerting centering forces against the edge regions to return the connector to a centered and aligned position. At least one of the centering beams includes a latch for engaging an aperture adjacent to the mounting aperture in the panel to enable float and centering in each of two opposite directions. The connector further includes a TPA component engaged to the rear of the connector housing in a preload condition and in a final seated position. The forward end of the TPA component includes secondary locking latches for engaging the terminals.

17 Claims, 6 Drawing Sheets

FLOATABLE ELECTRICAL CONNECTOR WITH TERMINAL POSITION ASSURANCE COMPONENT

BACKGROUND OF THE INVENTION

An electrical connector comprises a housing with at least one electrically conductive terminal mounted therein. The terminal is electrically connected to another circuit component, such as discrete wire or a conductive region on a circuit board. Connectors are employed in mateable pairs such that each terminal and the housing of one connector are mateable with a corresponding terminal and the housing in another connector.

The terminals of electrical connectors frequently are very small components that are stamped and/or formed from flat narrow strips of metal. The stamping and/or forming of the terminals is carried out to define a structure that will achieve a high normal contact force against a second terminal mated therewith for insuring a high quality electrical connection. If, for some reason, mated terminals do not exert a high normal contact force against one another, a high quality electrical connection may not be achieved.

The ability of the terminals in an electrical connector to exert high normal contact forces against a mated terminal can be affected by many factors. For example, in some instances, the locations of electrical connectors within an apparatus prevent accurate alignment of the connectors prior to or during mating. This may particularly be a problem where at least one connector in a mateable pair is mounted to a panel that prevents accurate visual alignment during mating. A technician attempting to blind mate improperly aligned panel mounted connectors may stop the mating in response to resistance generated by the improperly aligned connector housings. This may result in an incomplete connector mating, such that the terminals are not advanced into positions for exerting optimum normal contact forces against one another.

An attempt to mate improperly aligned connectors also may damage the small terminals therein or the housings. In particular, contact beams of the terminals typically are designed to resiliently deflect about a selected axis during normal mating. Improper alignment of terminals during mating can cause one or more contact beams to be overstressed, and thereby prevent the overstressed beam from resiliently returning toward an undeflected condition.

The prior art includes many panel mounted electrical connectors that are intended to float into proper alignment for mating. The prior art floatable panel mountable electrical connectors typically have cross-sectional dimensions that are less than the corresponding cross-sectional dimensions of the mounting aperture in the panel. Thus, these prior art connectors are able to move within the mounting aperture. Separation of these prior art connectors from the panel is prevented by flanges, washers, latches, or other such means defining cross-sectional dimensions that exceed the corresponding cross-sectional areas of the mounting aperture in the panel. It often is desirable to maximize the density of components on a panel. Thus space used by the float mechanism may be considered a design penalty that should be minimized.

Most prior art floating panel mountable connectors include biasing means for urging the connector back toward a central alignment in the mounting aperture of the panel. The centering means typically will define a separate structure from both the panel and the connector housing. However, the prior art does include floatable panel mountable connectors where the centering means is integral with the housing. Examples of prior art floatable panel mountable connectors with integral centering means include: U.S. Pat. No. 3,989,343 which issued to Lucius et al. on Nov. 2, 1976; U.S. Pat. No. 4,168,874 which issued to Weidler et al. on Sep. 25, 1979; U.S. Pat. No. 4,815,984 which issued to Sugiyama et al. on March 28, 1989; and, U.S. Pat. No. 4,840,584 which issued Cox on June 20, 1989.

Some of the above identified prior art floatable panel mountable connectors are urged generally back toward a central position in the mounting aperture of the panel after forces on the connector have been removed. However, most prior art connectors generally do not ensure that the connector will accurately return to a preferred rotational alignment relative to the mating axis of the connector. A very desirable floatable panel mountable connector capable of both transverse and rotational self-alignment is disclosed in co-pending application Ser. No. 470,482 which was filed by the inventors herein on Jan. 26, 1990 and which is assigned to the Assignee of the subject invention. The connector shown in co-pending application Ser. No. 470,482 includes a housing of generally rectangular cross-section with each wall of the housing being characterized by an array of deflectable panel engaging beams extending therefrom. A plurality of the beams in each such array may be centering beams which are disposed and dimensioned to exert centering and angular alignment forces against edge regions of the mounting aperture in the panel. At least one of the deflectable beams in each such array is a locking beam for lockingly engaging a surface of the panel. The disclosure of U.S. patent application Ser. No. 470,482 incorporated herein by reference.

A poor quality electrical connection may also occur if one or more terminals is not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with terminal position assurance (TPA) components which are constructed to detect incomplete insertion of the terminals. The automotive industry also generally requires locking means for locking the terminal in the housing. For example many connectors include deflectable latches inside the connector housing to lockingly engage the terminal after complete terminal insertion. These deflectable terminal engaging latches generally perform well. However the injection molded housings are subject to "short shots" where an insufficient amount of plastic is injected into a portion of a mold cavity. "Short shots" can result in some terminal engaging latches being omitted or being inoperative. The internal disposition of the latches makes visual quality control inspection difficult.

Most prior art TPA components are mountable to the front mating face of the connector and include structure which extends rearwardly into the connector for cooperating with terminal locking beams in the housing. For example, U.S. Pat. No. 4,557,542 issued to Coller et al. on Dec. 10, 1985 and discloses a wedge-like TPA component that is mountable to the front mating face of the housing. The wedge of the TPA component of U.S. Pat. No. 4,557,542 is urged between a pair of forwardly cantilevered terminal locking beams on the housing. An inability to fully insert the TPA wedge of U.S. Pat. No. 4,557,542 is intended to indicate incomplete mounting of a terminal in the housing. Additionally, complete seating of the TPA component is intended to prevent the terminal locking beams on the housing from deflecting free of the terminals. A similar structure is shown in U.S. Pat. No. 4,714,437 which issued to Dyki on Dec. 22, 1987. The TPA component shown in U.S. Pat. No. 4,714,437 also is mounted to the front mating face of the housing and includes a wedge which is urgeable between non-locking cantilevered beams on the housing. The wedge of the TPA component shown in U.S. Pat. No. 4,714,437 is operative to urge the terminals into static non-deflectable locking means disposed on outer walls of the housing. Another similar front mounting TPA component is shown in U.S. Pat. No. 4,826,452 which issued to Sian et al. on May 2, 1989. TPA components that are mountable to the front mating face of the connector housings often are considered undesirable in that they can limit options for designing the mating interface of pairs of electrical connectors and the terminals mounted therein.

An extremely desirable rear mountable TPA component is shown in U.S. Pat. No. 4,776,813 which issued to Wilson et al. on Oct. 11, 1988 and which is assigned to the Assignee of the subject invention. The TPA component shown in U.S. Pat. No. 4,776,813 is frictionally retained in the rear end of the connector housing and includes a forwardly projecting wedge that is urgeable between a plurality of forwardly cantilevered terminal locking beams of the housing. The terminals are inserted through the TPA component and into locked positions on the housing. The TPA component is then advanced from its initial frictionally mounted position into a final locked position. An inability to advance the TPA component into the final locked position is indicative of an improperly seated terminal. Conversely, the complete advancement of the TPA component prevents further deflection of the forwardly cantilevered terminal locking beams, and thus positively assures locking of the terminals in the housings.

Another very effective TPA component is shown in co-pending U.S. patent application Ser. No. 314,992 which was filed by Colleran et al. on Feb. 24, 1989 and which also is assigned to the Assignee of the subject application. The TPA component depicted in co-pending U.S. patent application Ser. No. 314,992 also is rear mounted and includes a forwardly projecting wedge. The wedge is urged between a pair of rearwardly cantilevered terminal locking beams of the housing. The housing may further include a second outwardly disposed pair of forwardly cantilevered terminal locking beams.

Still another very desirable rearwardly mounted TPA component is depicted in co-pending U.S. patent application Ser. No. 07/506,315 which was filed by Fred Love Krehbiel on April 9, 1990 and which also is assigned to the Assignee of the subject invention. The connector housing shown in co-pending U.S. patent application Ser. No. 506,315 includes rearwardly cantilevered terminal positioning beams which function to urge terminals outwardly and into engagement with static locking ramps on the housing. The wedge of the TPA component is urgeable between the terminal positioning beams when all of the terminals of the connector are fully seated and locked.

In view of the above, it is an object of the subject invention to provide a floatable panel mountable electrical connector that is self-centering and rotationally self-aligning in the mounting aperture of the panel.

It is another object of the subject invention to provide a floatable panel mountable connection having polarization means for ensuring a specified rotational alignment of the connector to the panel.

A further object of the subject invention is to provide a floatable panel mountable connector that is securely lockable to a panel, but that is selectively removable therefrom.

An additional object of the subject invention is to provide a connector having improved terminal position assurance means and terminal locking means for achieving accurate positioning of the terminals and high quality electrical connection.

Yet another object of the subject invention is to provide an electrical connector having a TPA component that is selectively lockable in alternate preload and final seated positions on the rear of a housing and that requires intentional activation of the locking means to advance between the preload and final seated positions.

SUMMARY OF THE INVENTION

The subject invention is directed to an electrical connector that is well-suited to environments where blind mating may be required and/or to high vibration environments where positive assured locking of terminals in a housing is required. In particular, the connector may be constructed to float on a panel during mating and to self-center on the panel prior to mating or after unmating. In this regard, the connector of the subject invention may comprise a housing having a body with a forward mating end, a rearward conductor receiving end and at least one terminal receiving cavity extending therebetween. The housing of the connector is dimensioned to float in a mounting cutout of a panel. More particularly, the housing comprises at least one portion defining minor cross-sectional dimensions which are less than corresponding cross-sectional dimensions of a mounting cutout in the panel. The housing may further include a plurality of mounting walls extending outwardly therefrom and defining cross-sectional dimensions which exceed the corresponding cross-sectional dimensions of the mounting cutout in the housing. The mounting walls are thus dimensioned to engage one face of the panel to which the electrical connector is mountable. The mounting walls may be unitarily molded with the connector housing and may comprise polarization means for ensuring proper orientation of the housing to the panel.

The housing of the subject electrical connector is further provided with a plurality of deflectable centering beams cantilevered from remaining portions of the housing. At least selected centering beams may define a major cross-sectional dimension on the housing approximately equal to or slightly greater than corresponding cross-sectional dimensions of the mounting cutout in the panel. Thus, the centering beams will deflect to permit float of the connector relative to the mounting cutout in the panel, but will resiliently return toward undeflected conditions to center and self-align the connector in the mounting of the panel. Each centering beam may include a panel engaging wall extending therefrom for engaging a surface of the panel opposite the mounting walls of the connector. Thus, the panel will effectively be trapped between the mounting walls of the connector housing and the panel engaging walls of the centering beams. The panel engaging walls may be disposed to lie in a common plane which extends generally parallel to the plane defined by the mounting walls of the housing. The distance between the plane of the mounting walls and the plane of the panel engaging walls may be equal to or slightly greater than the thickness of the panel to facilitate float of the connector relative to the panel. Each centering beam may be relatively wide to facilitate angular self-alignment in response to angular float of the connector.

The connector of the subject invention may be adapted for mounting in a portion of a panel as, for example, adjacent to an edge thereof. In particular, the mounting cutout may define a slot extending into an edge of the panel, and the connector housing may be mounted to the panel by moving the connector in a direction transverse to the mating axis thereof and generally in the plane of the panel. In this embodiment, the panel may further include a locking aperture extending therethrough in spaced relationship to the mounting cutout. One of the centering beams may then include a latch for engaging the locking aperture in the panel. The latch may extend from and define a portion of the panel engaging wall on the centering beam. In this regard, the centering beam having the latch thereon will function to center the connector in two directions as explained further herein. The latch extending from the centering beam may include a ramped face to facilitate the locked mounting of the connector to the panel.

The connector may additionally or alternatively include a plurality of terminal receiving cavities extending through the housing, each of which is adapted to lockingly receive a terminal therein. The connector may further comprise terminal position assurance (TPA) means for assuring full seating and locking of the terminals in the housing. In particular, the connector housing may include a forward mating face and a rearward conductor receiving face with the terminal receiving cavities extending therebetween. Each terminal may be stamped and formed from conductive material and may include a pair of locking windows therein. The locking windows may be on opposite sides of the terminal and in register with one another. The housing may be molded to include a deflectable locking lever cantilevered into each terminal receiving cavity and disposed and dimensioned to lockingly engage the window of the terminal upon complete insertion of the terminal into the terminal receiving cavity of the housing. The housing may further be characterized by at least one divider wall centrally disposed between a plurality of the terminal receiving cavities. The divider wall may include rearwardly facing ramped faces dimensioned to cooperate with the TPA component as explained further herein. The rear conductor receiving end of the housing may further be provided with locking means for lockingly engaging the TPA component in alternate first and second positions thereon.

The TPA component is dimensioned for locked engagement to the rear conductor receiving end of the housing. More particularly, the TPA component may include deflectable locking means for selectively engaging the rear end of the housing in a first pre-load position and in a second fully seated position. Movement of the TPA component from the pre-load position to the final seated position may require deflection of at least one deflectable locking member of the TPA component to thereby prevent unintentional advancement of the TPA component from the pre-load position to the final seated position. The locking member of the TPA component may be dimensioned to extend beyond the rear end of the connector housing to facilitate the deflection for selectively removing the TPA component from the connector housing to enable disassembly of the connector for repair.

The TPA component includes at least one forwardly projecting locking structure defined by a plurality of deflectable cantilevered locking fingers dimensioned and disposed for locked engagement with a window on the associated terminal. The locking fingers of the TPA component are forwardly extending and disposed in spaced relationship to one another to permit the divider wall of the housing to be inserted therebetween. The relative configurations of the locking fingers on the TPA component and the divider on the housing are such that the locking fingers are slightly spaced from the terminal when the TPA component is in the preload position. However, movement of the TPA component toward the fully seated position causes the locking fingers to cooperate with the divider wall and to be urged into contact with a respective terminal. If the terminal is fully seated, the locking fingers will be urged into locked engagement with the window on a respective terminal. If the terminal is partially seated the locking fingers will contact the terminal wall preventing further movement of the TPA component. In this regard, the TPA component performs a position assurance function and a redundant locking function. The redundant locking function of the TPA component will compensate for a potential "short shot" in the injection molding of the housing that conceivably could result in weak and ineffective locking members on a portion of the connector housing.

In a preferred embodiment, as explained and illustrated further herein, the above described TPA component is incorporated into the above described floatable panel mountable connector. However, these two desirable structures need not be incorporated into the same connector and may be employed independently of one another.

DETAILED DESCRIPTION OF THE PREFERRED EMBODIMENT

Figure 1:
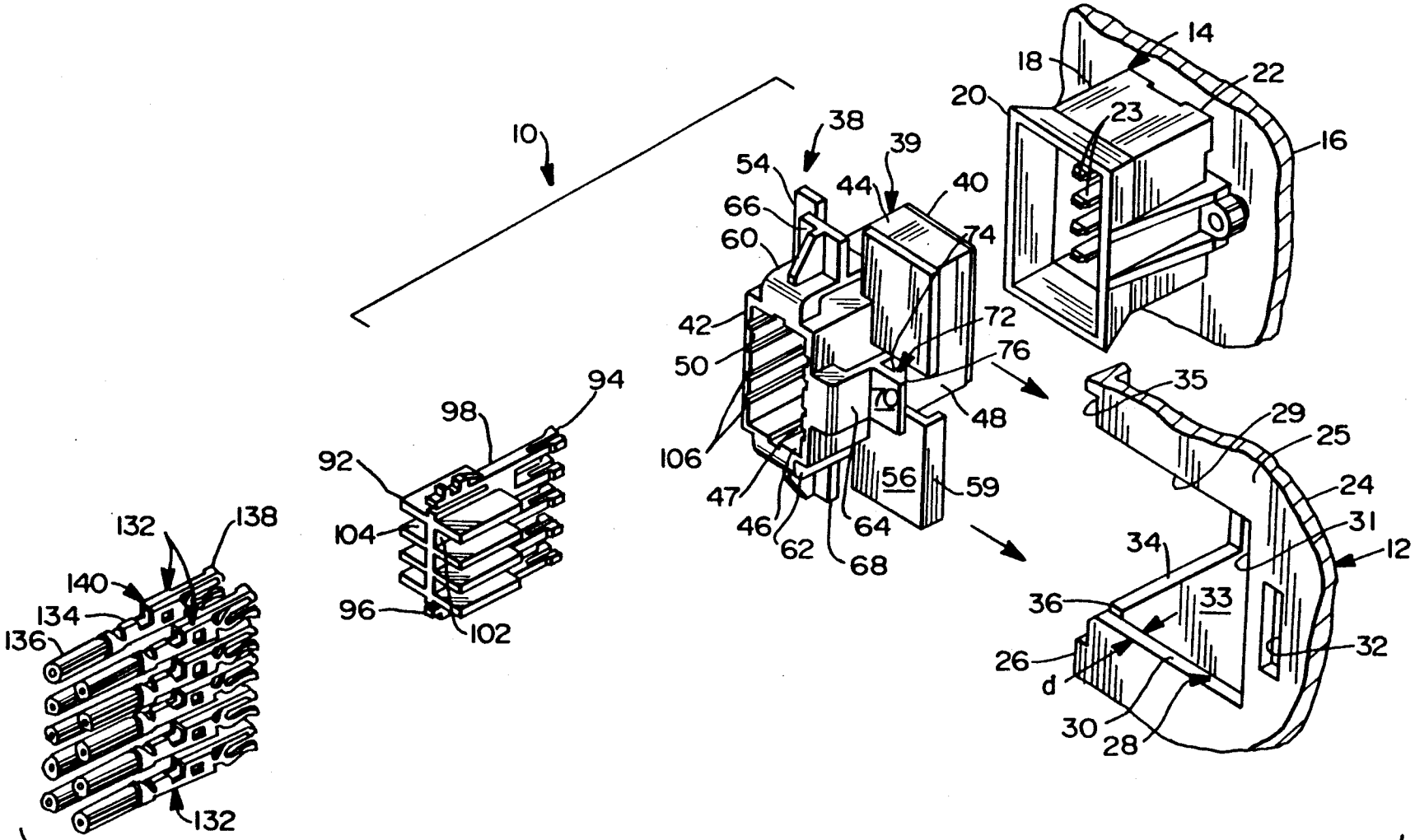
FIG. 1 is an exploded perspective view of the connector of the subject invention.
Figure 2:
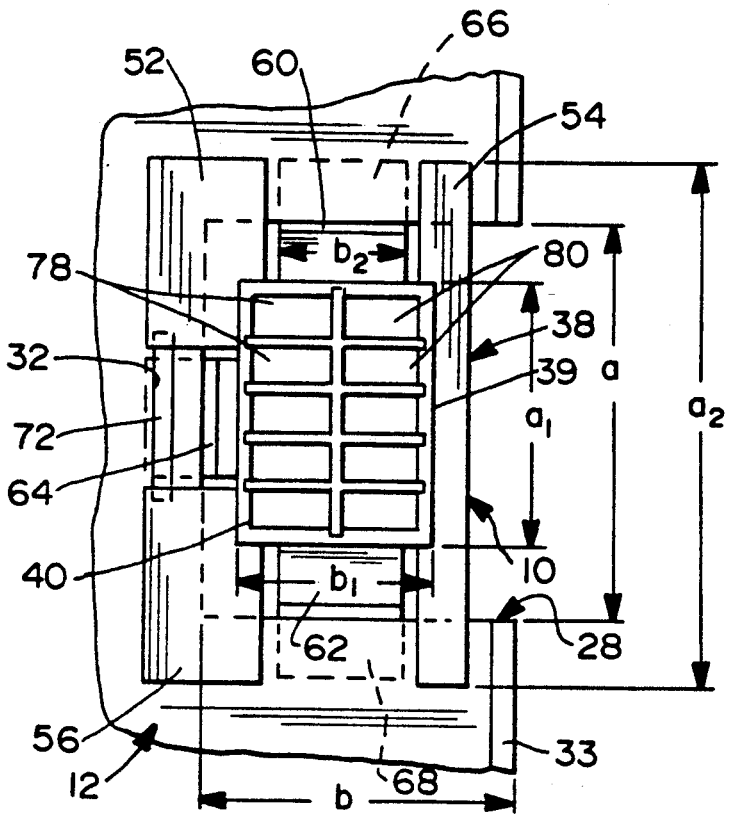
FIG. 2 is a front elevational view of the connector mounted to the panel and disposed in an unbiased floating position thereon.
Figure 3:
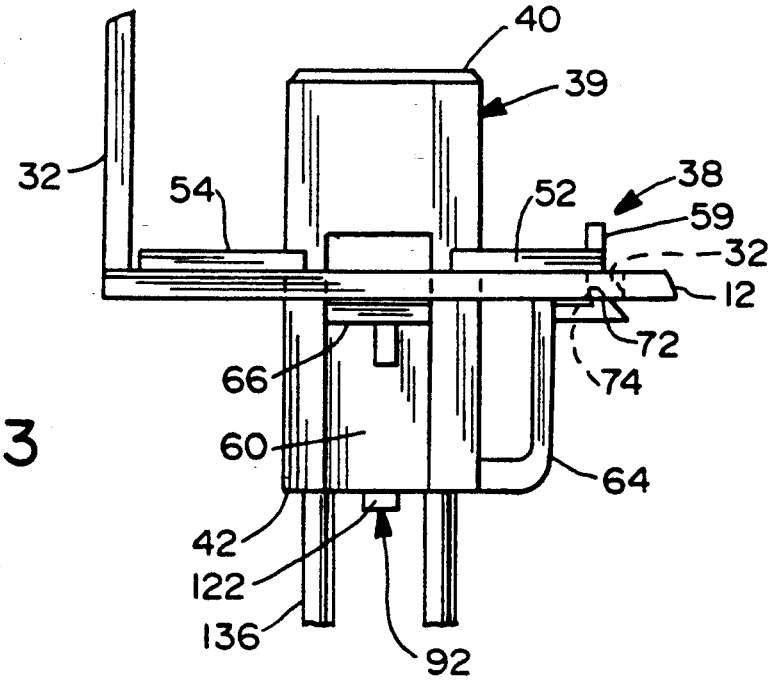
FIG. 3 is a top plan view of the connector in the orientation depicted in FIG. 1.
Figure 4:
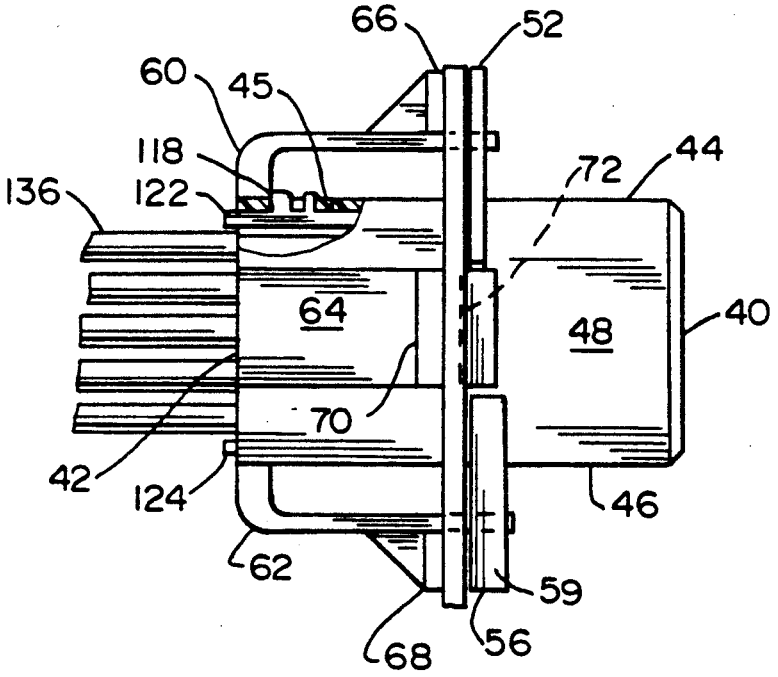
FIG. 4 is a side elevational view, partly in section, of the connector as shown in FIGS. 2 and 3.

The connector of the subject invention is identified generally by the numeral 10 in FIGS. 1-5 and 8-10. As shown in FIG. 1 the connector 10 is mountable to a panel 12 which may define a portion of the instrument panel for an automotive vehicle. The connector 10 is selectively mateable and unmateable with a second connector 14 which, in turn, is mounted to a second panel 16 that may define a portion of the dashboard or instrument panel of a vehicle. The connector 14 includes a unitarily molded non-conductive housing 18 having a forward mating end 20 for mating with the connector 10 as explained below and a rearward panel mounting end 22 for mounting to the panel 16. The housing 18 of the connector 14 is constructed to define terminal receiving cavities extending between the forward mating end 20 and the rearward panel mounting end 22, with a plurality of male terminals 23 mounted therein and electrically connected to appropriate circuitry on the panel 16. The connector 10 and the connector 14 are mateable with one another under blind mating conditions by urging at least one of the panels 12 and 16 toward the other. Accurate alignment of the connectors 10 and 14 during such mating cannot always be assured in view of the limited space and relative inaccessibility of the components on the automobile. As explained above, attempts to mate improperly aligned electrical connectors can damage the terminals or the housings of the connectors or can result in incomplete or improper mating. To ensure proper alignment, the connector 10 is floatably mounted to the panel 12 and is self-centering to ensure that the connector 10 will be aligned in a central position from which floating can occur during subsequent matings.

The panel 12 includes opposed first and second surfaces 24 and 25, an edge region 26 and a mounting cutout 28 extending into the panel 12 from the edge region 26. The mounting cutout 28 in the panel 12 is of generally rectangular configuration and is defined by opposed generally parallel top and bottom edges 29 and 30 and a side aperture edge 31. The top and bottom edges 29 and 30 are spaced from one another by distance "a" as shown in FIG. 1. The side edge 31 is spaced from the edge region 26 of the panel 12 by distance "b" as also shown in FIG. 1. The panel 12 is further characterized by an elongated locking aperture 32 which extends generally parallel to the side edge 31 at a distance "c" therefrom.

A transverse panel 33 extends generally orthogonally from the panel 12 and adjacent the edge region 26 thereof. The transverse panel 33 defines a mounting cutout 34, and top and bottom notches 35 and 36, respectively, adjacent the panel 12. The top notch 35 is narrower than the bottom notch 36 and contributes to polarized mounting of the connector 10 to the panel 12, as explained below.

The connector 10 includes a unitarily molded non-conductive housing 38 having a body 39 with a forward mating end 40 and an opposed conductor receiving end 42, with a plurality of terminal receiving cavities extending therebetween. The terminal receiving cavities are not illustrated in FIG. 1 but are illustrated and described in greater detail below. The forward mating end 40 of the housing body 39 is dimensioned to be matingly received in the forward mating end 20 of the connector 14. Portions of the housing body 39 between the forward mating end 40 and the rearward end 42 are of generally rectangular cross-sectional configuration, with opposed top and bottom walls 44 and 46 and opposed first and second side walls 48 and 50. Portions of the top and bottom walls 44 and 46 in proximity to the rearward end 42 are provided with locking apertures 45 and 47 respectively. The height of the housing body 39, as measured between the top and bottom walls 44 and 46 thereof, is defined by dimension "$a_1$" as depicted in FIG. 1, which is less than the height "a" of the mounting cutout 28 in the panel 12. Similarly, the width of the housing body 39 as defined by the opposed side walls 48 and 50 is defined by dimension "$b_1$" which is less than the distance "b" measured between the edge region 26 of the panel 12 and the side edge 31 thereof.

The housing 38 is characterized by a plurality of mounting walls extending orthogonally from the housing body 39 for engagement with the first surface 24 of the panel 12. More particularly, a top mounting wall 52 extends outwardly from regions of the housing body 34 adjacent the top wall 44 thereof and the first side wall 46. Similarly, a side mounting wall 54 extends orthogonally outwardly from the housing body 39 adjacent the second side wall 50 and continuously beyond top and bottom walls 44 and 46. In a similar manner, a bottom mounting wall 56 extends orthogonally outwardly from the housing body 39 adjacent the bottom wall 46 and the first side wall 48. The bottom mounting wall 56 is characterized by a polarization projection 59 which is dimensioned to be received in the wider top notch 35 of the panel 33 to ensure proper rotational alignment of the connector 10 relative to the panel 12.

The mounting walls 52-56 define an overall height "$a_2$" which is substantially greater than the overall height "a" of the mounting cutout 28. These dimensions ensure that the connector 10 can float in the mounting cutout 28 without separating from the panel 12.

The housing 38 of the connector 10 is further characterized by top and bottom centering beams 60 and 62 and a side centering beam 64. More particularly, the top centering beam 60 is cantilevered from a portion of the top wall 44 of the housing body 39 generally adjacent the rear end 42 thereof and extends forwardly intermediate the top and side mounting walls 52 and 54. The top centering beam 60 is aligned in its unbiased condition to extend substantially parallel to the top wall 44 of the housing body 39. The top centering beam 60 includes a panel engaging wall 66 extending outwardly generally orthogonal to the top centering beam 60. The panel engaging wall 66 is generally planar and extends generally parallel to the plane defined by the mounting walls 52-56, and is disposed intermediate the plane defined by the mounting walls 52-56 and the rear end 42 of the housing. The distance between the plane of the mounting walls 52-58 and the panel engaging wall 66 is substantially equal to the thickness "d" of the panel 12. The overall width of the centering beam 60 and the panel engaging wall 66 is identified generally by "$b_2$" and preferably is equal to more than one-half the width "$b_1$" of the housing body 39.

The bottom centering beam 62 is virtually identical to the top centering beam 60. In particular, the bottom centering beam 62 is cantilevered from a portion of the housing body 39 generally adjacent the rear end 42 thereof and extends forwardly to a location forward of or intermediate the bottom mounting wall 56 and the second side mounting wall 54. The bottom centering beam 62 also is characterized by a bottom panel engaging wall 68 extending orthogonally therefrom and generally in the plane of the top panel engaging wall 66. The overall height defined by portions of the top and bottom centering beams 60 and 62 at locations thereon forward of the top and bottom panel engaging walls 66 and 68 is approximately equal to the overall height "a" of the mounting cutout 28 in the panel 12. The top and bottom centering beams 60 and 62 cooperate with one another to help center the housing 38 between the top and bottom edges 29 and 30 of the cutout 28 in the panel 12. Additionally, the top and bottom centering beams 60 and 62 will contribute to rotational self-alignment of the connector 10.

The side centering beam 64 extends from a portion of the first side wall 48 generally adjacent the rear end 42 of the housing body 39 and is cantilevered forwardly to a location intermediate or forward of the top mounting wall 52 and the bottom mounting wall 56. The first side centering beam 64 defines a width "$b_2$" approximately equal to the width of the respective top and bottom centering beams 60 and 62, and is cantilevered from a region of the first side wall 48 substantially mid-way between the top and bottom walls 44 and 46. The first side centering beam is further characterized by a side panel engaging wall 70 extending generally orthogonally therefrom and lying substantially in the same plane as the top and bottom panel engaging walls 66 and 68. However, the side panel engaging wall 70 is characterized by a forwardly projecting locking latch 72 at the end thereof remote from the side centering beam 64. The locking latch 72 is characterized by a locking surface 74 which is generally parallel to the first side wall 48 and which is spaced from the side centering beam 64 by distance "$c_1$" which is approximately equal to or slightly greater than the distance "c" between the locking aperture 32 in the panel 12 and the side edge 31 of the mounting cutout 28 therein. The locking projection 72 is further characterized by a ramped leading face 76 which is operative to generate deflection of the panel engaging wall 70 and portions of the side centering beam 64 during mounting of the housing 46 to the panel 12.

FIGS. 2 and 8–11 illustrate a pair of terminal receiving cavities 78 and 80 formed between the side walls 48 and 50 respectively. It will be noted that the terminal receiving cavities are disposed generally in proximity to the front mating end 40 of the housing 38, with interior portions of the housing 38 adjacent the rear end 42 thereof being substantially opened. It will be understood that the terminal receiving cavities 78 and 80 shown in FIGS. 8–11 define one of five pairs of terminal receiving cavities disposed in the housing 38. Other connectors may be provided with more than or fewer than the five pairs of side-by-side terminal receiving cavities depicted herein. The terminal receiving cavities 78 and 80 in each such pair include a divider wall 82 disposed centrally therebetween. The rearward end of the divider wall 82 defines first and second ramped surfaces 84 and 86 generally facing the rearward entry to the respective first and second terminal receiving cavities 78 and 80 in each pair. The housing 38 further includes first and second terminal latches 88 and 90 which are cantilevered forwardly into the respective first and second terminal receiving cavities 78 and 80 in each pair. The latches 88 and 90 are disposed and dimensioned to deflect during the rear-to-front insertion of the terminals into the housing 38 and to then resiliently return to an undeflected condition upon complete insertion of the terminals for lockingly engaging windows formed in the respective terminals.

The TPA component of the connector 10 is identified generally by the numeral 92 in FIGS. 1, 7–11. The TPA component 92 includes opposed forward and rearward ends 94 and 96, a top 98 and a bottom 100. A central supporting wall 102 extends between the top 98 and the bottom 100 from a location generally adjacent the rear 96 of the TPA component 92 to a location intermediate the opposed front and rear 94 and 96 thereof. A plurality of dividing walls 104 extend transversely from the central supporting wall 102 and are slidably engageable in grooves 106 defined on interior regions of the housing 38 generally adjacent the rear end 42 thereof, as depicted most clearly in FIG. 1. The transverse dividing walls 104 function to divide the interior of the housing 38 generally adjacent the rear end 42 thereof into terminal receiving cavities that are aligned respectively with the first and second terminal receiving cavities 78 and 80 in each pair defined in the housing 38 as depicted in FIGS. 1 and 8–11 above.

The TPA component 92 is further characterized by top and bottom locking latches 106 and 108 which are cantilevered to extend rearwardly from the respective top and bottom portions 98 and 100 of the central supporting wall 102. The locking latches 106 and 108 define forwardly facing ramps 110 and 112 respectively for generating an inward collapsing of the locking latches 106 and 108 during initial insertion of the TPA component 92 into the rear end 42 of the housing 38. The locking latches 106 and 108 are further characterized by preload locking notches 114 and 116 disposed rearwardly of the ramps 110 and 112 respectively. The distance "d" between the preload locking notches 114 and 116 is approximately equal to the internal height of the interior of the housing 38 generally adjacent the rear end 42 thereof. Thus, the preload locking notches 114 and 116 will be disposed in substantially abutting face to face relationship with the interior surfaces of the housing 38 when the TPA component 92 is in the preload position, as explained further below.

Locking detents 118 and 120 are formed on the latches 106 and 108 respectively rearwardly of the preload locking notches 114 and 116 respectively. The forward faces of the locking detents 118 and 120 are chamfered to facilitate the intentional advancement of the TPA component 92 beyond the preload position. However, the rearward faces of the locking detents 118 and 120 are aligned in a common plane substantially orthogonal to the longitudinal direction of the TPA component 92. Surfaces 122 and 124 of the latches 106 and 108 rearwardly of the detents 118 and 120 are substantially planar and lie in the same planes as the respective preload locking notches 114 and 116. The surfaces 122 and 124 extend rearwardly beyond the rear face 96. Portions of each surface 122 and 124 will be engaged in abutting face to face relationship with interior regions of the housing 38 when the TPA component 92 is moved into its fully seated position. However, portions of the surfaces 122 and 124 remote from the detents 118 and 120 will extend beyond the housing 38 to enable intentional disengagement of the TPA component 92 from its fully seated position, as explained further herein.

The forward end 94 of the TPA component 92 is defined by first and second deflectable locking fingers 126 and 128 which are cantilevered from the central supporting portion 102 and which define a space 130 therebetween. The locking fingers 126 and 128 are dimensioned to lockingly engage windows on the terminals, as explained further below.

Returning to FIG. 1, the connector 10 is dimensioned to lockingly receive and precisely position a plurality of terminals 132. Each terminal 132 is stamped and formed from a unitary piece of metal material and has a rearward wire engaging end 134 for termination to a wire 136. The opposed mating end 138 of the terminal 132 is constructed to mate with a terminal 23 in the connector 14. The mating end 138 of each terminal 132 will be disposed in one of the terminal receiving cavities 78, 80 of the housing 38 generally adjacent the forward mating end 40 thereof. Each terminal further includes two locking windows 140 intermediate the forward mating end 138 and the rearward wire receiving end 134 thereof. The locking windows 140 of each terminal 132 are disposed symmetrically in register with one another such that the terminal can be inserted in either of two rotational orientations separated from one another by 180°. The locking windows 140 are disposed and dimensioned to be engaged by either the locking latches 88 or 90 on the housing 38 or the locking fingers 126 or 128 on the TPA component 92 as explained below.

Figure 8:
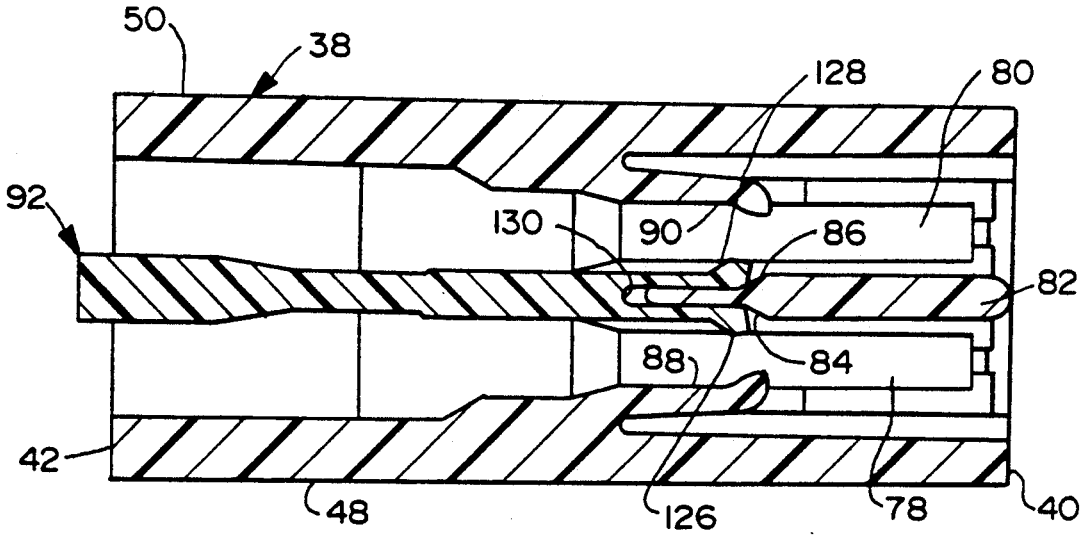
FIG. 8 is a cross-sectional view taken along 8—8 in FIG. 2 and showing the TPA component in a pre-load condition and prior to insertion of the terminals in the housing.

The connector is assembled by first inserting the TPA component 92 into the rearward end 42 of the housing 38. More particularly, the TPA component 92 is advanced forwardly such that the ramps 110 and 112 on the TPA latches 106 and 108 engage the top and bottom walls 44 and 46, respectively, of the housing 38. The ramping forces generated by this forward movement will cause the TPA latches 106 and 108 to deflect inwardly to permit continued forward movement of the TPA component 92 into the housing 38. However, upon sufficient forward movement of the TPA component 92, the ramps 110 and 112 will align with the locking apertures 45 and 47 on the housing 38 to enable the latches 106 and 108 to resiliently return toward an undeflected condition with the preload locking notches engaging portions of the top and bottom walls rearward of the locking apertures 45 and 47 such that TPA component is locked in a preload position. In this preload position, the surfaces 122 and 124 at the extreme rearward ends of the latches 106 and 108 will extend rearwardly beyond the rear face 42 of the housing 38. As shown in FIG. 8, the locking fingers 126 and 128 of the TPA component 92 will be disposed on opposite respective sides of the divider wall 82 which separates the terminal receiving cavities 78 and 80 from one another within the housing 38. However, the relative dimension of the gap 130 between the locking fingers 126 and 128 and the dimensions of the ramped faces 84 and 86 at the extreme rearward end of the divider wall 82 ensure that the locking fingers 126 and 128 will not be disposed in the terminal receiving cavities 78 and 80. The housing 38 with the TPA component 92 engaged in the preload position depicted in FIG. 8 may be transported from an initial manufacturing location to a final assembly location.

Figure 9:
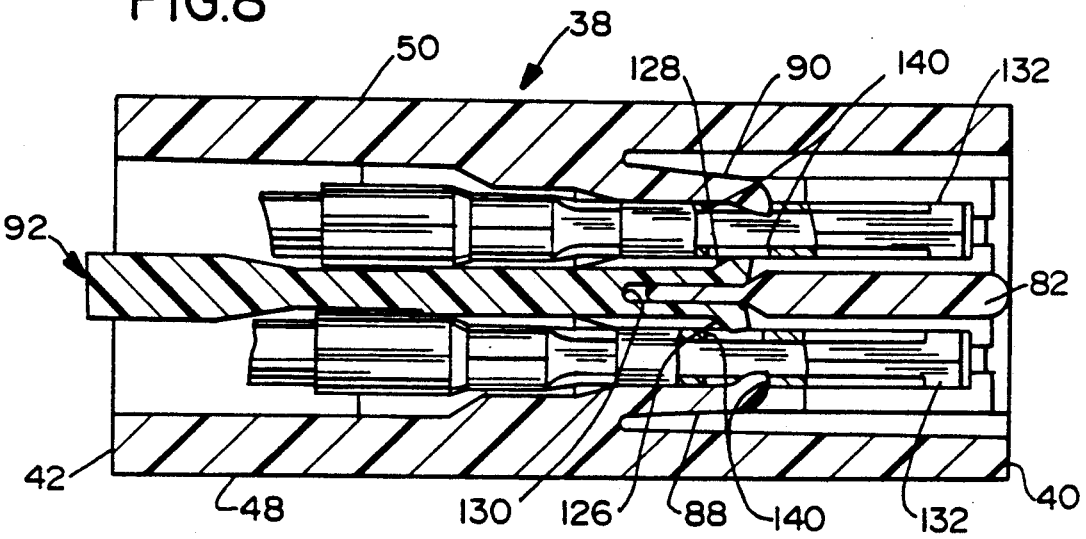
FIG. 9 is a cross-sectional view similar to FIG. 8 but showing the terminals in a fully seated condition.
Figure 11:
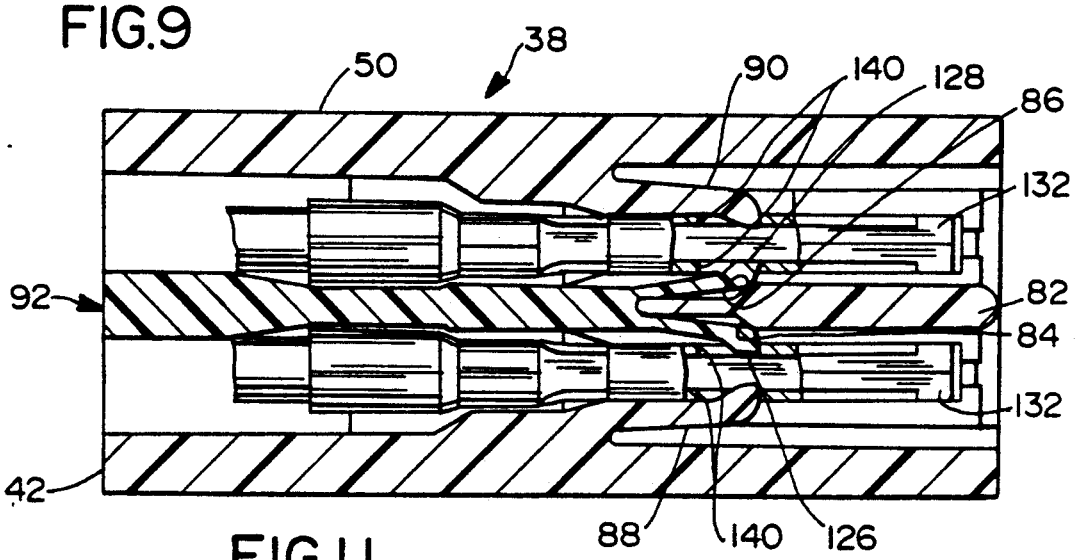
FIG. 11 is a cross-sectional view similar to FIGS. 8 and 9 but showing the TPA component fully seated and locked with the terminals.
Figure 10:
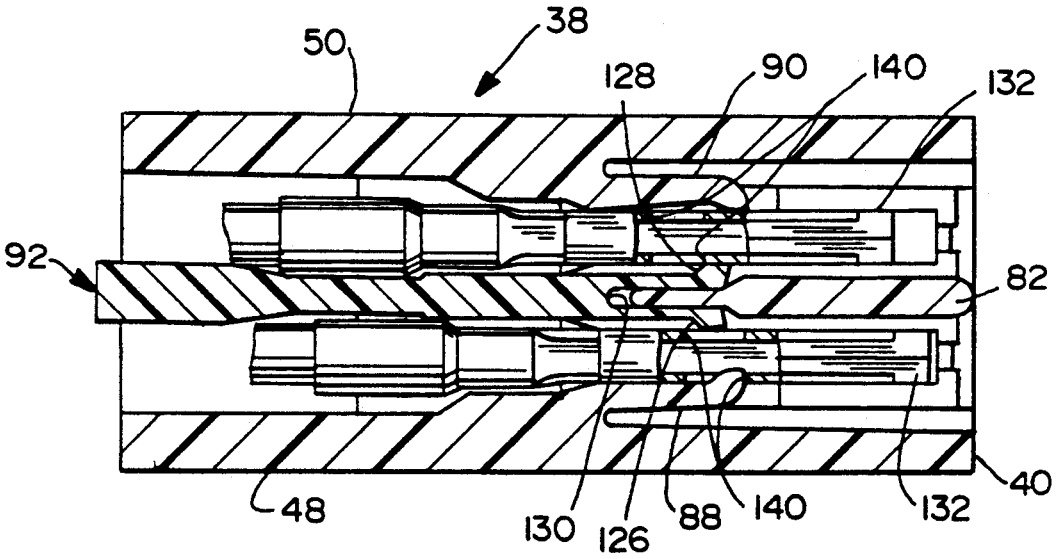
FIG. 10 is a cross-sectional view similar to FIG. 9 but showing the lower terminal in a fully seated condition and the upper terminal in a partial seated condition.

Assembly of the connector 10 proceeds by inserting the terminals 132 into the respective terminal receiving cavities 78, 80 of the housing 38. Rearward ends of the terminal receiving cavities 78, 80 are defined by the dividing walls 104 of the TPA component 92. The movement of the terminals 132 into the respective terminal receiving cavities 78, 80 will cause the latches 88 and 90 of the housing 38 to initially deflect and to subsequently lockingly engage the windows 140 in the terminals 132. With reference to FIG. 9, it will be noted that the terminals 132 do not engage the locking fingers 126 and 128 of the TPA component 92, but rather pass in close proximity thereto.

After the terminals have been advanced into the fully seated condition, the positions of the terminals can be assured and secondarily locked by moving the TPA component 92 forwardly in the housing 38. This forward movement is achieved by urging the latches 106 and 108 at the rearward end 96 of the TPA component 92 inwardly toward one another, and simultaneously urging the TPA component 92 forwardly. Upon complete seating, the latches 106 and 108 will resiliently return toward an undeflected condition with the rearward faces of the locking detents 118 and 120 engaging the corresponding locking apertures 45 and 47 on the top and bottom walls 44 and 46 of the housing 38. This locked engagement will prevent an unintended rearward separation of the TPA component 92 from the housing 38.

As the TPA component 92 is advanced into the fully seated position on the housing 38, the locking fingers 126 and 128 will deflect away from one another in response to ramping forces created against the ramped faces 84 and 86 of the divider wall 82. As shown most clearly in FIG. 10, these ramping forces will urge the locking fingers 126 and 128 away from one another and into the windows 140 of the terminals 132 to achieve a secondary locking therewith. The movement of the locking fingers 126 and 128 into the respective windows 140 of the terminals 132 achieves several functions. First, the locking fingers 126 and 128 perform a redundant locking which supplements the terminal locking achieved by the primary latches 88 and 90 which are unitarily molded with the housing 38. However, as noted above, "short shots" during injection molding processes conceivably can render some internal regions of the housing 38 structurally ineffective. These internal defects are difficult to visually detect. However, the locking fingers 126 and 128 of the TPA component 92 are readily visually inspectable prior to insertion of the TPA component 92 into the housing 38. Thus, each terminal 132 will be ensured of at least a secondary locking in the housing 38 which will offset any potential local weakness in the housing 38 that results from short shots in the molding process. Additionally, the locking fingers 126 and 128 perform the position assurance function required for TPA components. In this regard, an incompletely inserted terminal 132 will result in a window 140 that is not properly aligned to receive the locking fingers 126, 128 of the TPA component 92. The inability of the locking finger 126 or 128 from being advanced into a window 140 of a terminal 132 will prevent the TPA component 92 from being advanced into the fully seated position, and thus will provide clear indication of an incompletely inserted terminal 132.

In the fully seated position of the TPA component 92, the extreme rearward surfaces 122 and 124 of the latches 106 and 108 will extend beyond the rear face 42 of the housing 38. These small surface areas may be employed to intentionally urge the latches 106 and 108 toward one another for disengaging the TPA component 92 from the housing 38. Such disengagement may be necessary if a completed connector 10 does not perform electrically as required. For example, after complete assembly it may be determined that a termination of a terminal 132 to a wire 136 does not meet specifications or that the mating end 138 of a terminal 132 does not perform as specified. The ability to intentionally withdraw the TPA component 92 from the housing 38 enables appropriate repairs or replacements to be made.

Assembly of the connector proceeds by merely urging the connector 10 into the mounting cutout 28 in the panel 12. Proper polarization of the connector 10 in the panel 12 is achieved by the polarization wall 60 which is specifically dimensioned to be received in the bottom notch 36 adjacent the edge 26 of the panel 12. Continued advance of the connector 10 into the mounting cutout 28 will cause the panel 12 to be slid between the mounting walls 52–58 and the panel engaging walls 66 and 68 of the respective centering beams 60 and 62. Further movement of the connector 10 into the mounting cutout 28 will cause the ramped leading surface 76 of the panel latch 72 to engage the side edge 31 of the mounting cutout 28. Ramped forces will cause deflection of the panel engaging wall 70 and the centering beam 64 such that the connector 10 may be advanced further. Upon sufficient insertion, the locking edge 74 will align with the locking aperture 32 in the panel 12 enabling the panel engaging wall 70 and the centering beam 64 to resiliently return toward undeflected positions such that the latch 72 positively retains the connector 10 to the panel 12.

Figure 5:
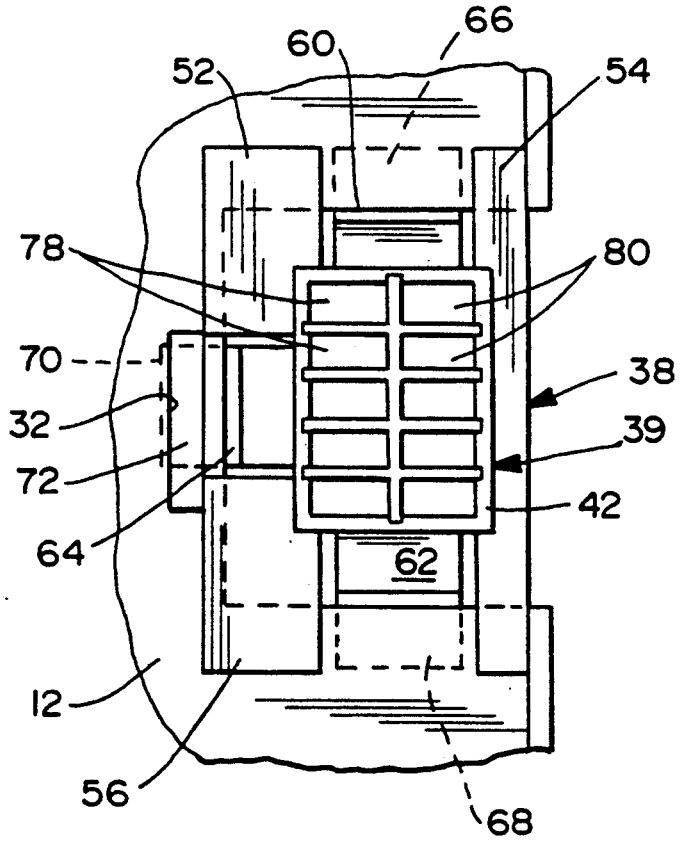
FIG. 5 is a front elevational view similar to FIG. 2 but showing the connector biased into a misaligned condition.
Figure 6:
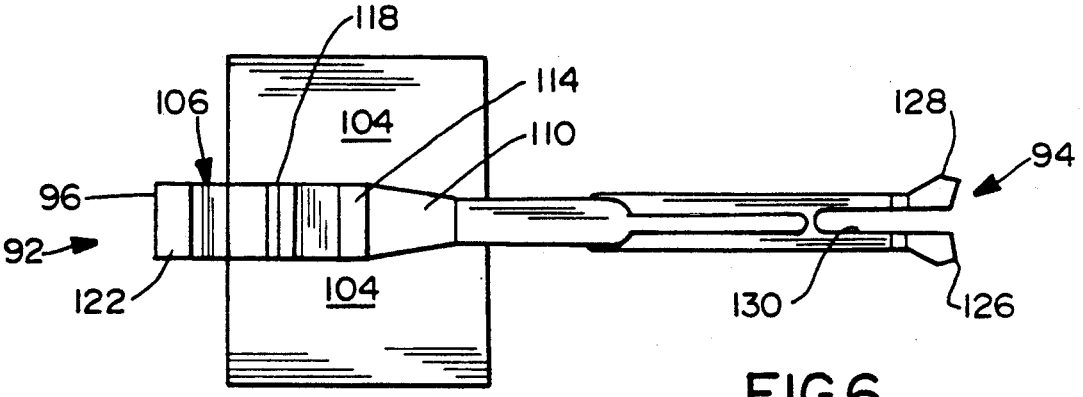
FIG. 6 is a top plan view of the TPA component of the subject invention.
Figure 7:
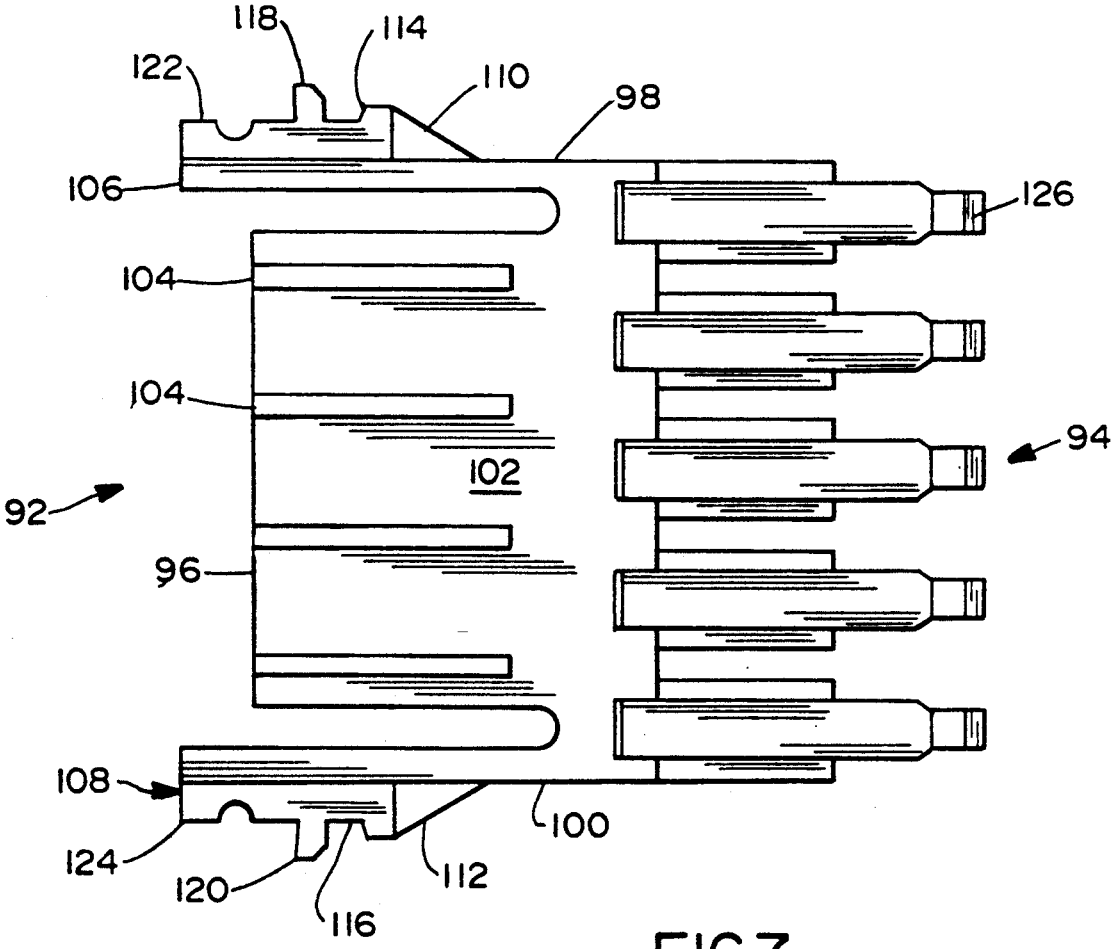
FIG. 7 is a side elevational view of the TPA component depicted in FIG. 6.

As explained above, accurate alignment of the panel mounted connector 10 to the panel mounted connector 14 cannot be assured prior to mating. However, the deflectable centering beams 60, 62 and 64 will enable the connector 10 to float within the mounting cutout 28 (as shown in FIG. 5) for achieving an efficient mating without damaging any portions of the connectors 10 and 14. The centering beams 60, 62 and 64 will enable the connector 10 to resiliently return to a centered and rotationally aligned position in the cutout 28 upon release of the mating forces.

While the invention has been described with respect to a preferred embodiment, it is apparent that various changes can be made without departing from the scope of the invention. For example, the float mechanism described for the connector herein may be employed on connectors having no TPA component or having a TPA component that is different from that depicted and described above. Similarly, the extremely desirable TPA component described in detail above may be employed on connectors having no float mechanism or a different float mechanism from that depicted herein.

We claim:

1. A floatable electrical connector for mounting to a panel having opposed first and second surfaces, at least one edge and a locking aperture extending into at least one surface at a location on the panel spaced from the edge, a mounting cutout formed entirely through the panel and extending inwardly from said edge to a location spaced from the locking aperture of the panel, said connector comprising: a housing having a body for receiving at least one terminal therein, said body being dimensioned to fit in the mounting cutout of the panel with relative movement therebetween; means for engaging portions of the first and second surfaces of the panel adjacent the mounting cutout therein; a plurality of deflectable centering beams cantilevered from the housing and being selectively deflectable toward and away from the body of the housing and dimensioned to engage portions of the panel defining the mounting cutout, one of said deflectable centering beams including latch means for engaging the locking aperture in the panel, whereby the deflectable centering beams and the latch means permit float of the connector housing within the mounting cutout of the panel and enable centering of the connector subsequent to said floating.

2. An electrical connector as in claim 1 wherein the means for engaging the first surface of the panel comprises walls extending outwardly from the body of the housing and being disposed in a first plane.

3. An electrical connector as in claim 2 wherein the mounting walls comprise polarization means for enabling polarized mounting of the connector to the panel.

4. An electrical connector as in claim 2 wherein the means for engaging the second surface of the panel comprises panel engaging walls extending outwardly from at least one of said defectable centering beams.

5. A connector as in claim 4 wherein the housing includes a forward mating end and an opposed rearward conductor receiving end, said mounting walls extending outwardly from the housing at a location intermediate the opposed forward and rearward ends, said centering beams being cantilevered from a location on the housing generally adjacent the rearward end thereof and extending forwardly therefrom, each said deflectable centering beam extending intermediate a pair of the mounting walls of the connector.

6. An electrical connector as in claim 4 wherein the housing body is of generally rectangular cross-sectional configuration with a forward mating end, a rearward conductor receiving end, opposed top and bottom walls extending between the forward and rearward ends and opposed first and second side walls extending between the top and bottom walls, the mounting cutout of the panel including top and bottom mounting edges extending generally orthogonally from the edge of the panel and being spaced from one another by a distance greater than the height of the connector defined by the top and bottom walls of the body, the centering beams including a side centering beam cantilevered from a portion of the first side wall generally adjacent the rearward end of the housing and extending forwardly therefrom, the panel engaging wall of the side centering beam including the latch thereon for engaging the locking aperture of the panel.

7. An electrical connector as in claim 6 wherein the latch on the panel engaging wall of the side centering beam includes a ramped leading face for generating deflection of the side centering beam and the panel engaging wall thereof in response to ramping forces generated by engagement of the latch with the panel at the mounting cutout therein.

8. A connector as in claim 1 further including a terminal position assurance component lockingly engagable to the body of the housing in alternate first and second positions thereon, the first position of the terminal position assurance component defining a preload position enabling insertion of a terminal into the housing, the second position defining a final seated position for lockingly retaining the terminal in the housing and ensuring accurate seating thereof.

9. An electrical connector as in claim 8 wherein the terminal position assurance component includes a pair of deflectable locking fingers, said housing including a divider wall for urging the locking fingers, of the terminal position assurance component into locked engagement with a fully inserted terminal disposed in the housing.

10. An electrical connector as in claim 9 wherein the housing includes a forward mating end and an opposed rearward conductor receiving end, said terminal position assurance component being engagable in the rearward end of the housing.

11. An electrical connector as in claim 8 wherein the terminal position assurance component includes a pair of deflectable housing engaging latches, said latches being engagable with the housing in the preload position of the terminal position assurance component therein and being selectively deflectable to urge said terminal position assurance component into the final seated position in said housing.

12. An electrical connector comprising a housing having a forward mating end and an opposed rearward end and a plurality of terminal receiving cavities extending therebetween, each said terminal receiving cavity being separated from at least one other terminal receiving cavity by a divider wall having ramped surfaces diverging toward the terminal receiving cavities, said connector further comprising a TPA component having a terminal locking end defined by a plurality of spaced apart locking fingers for lockingly engaging a terminal inserted into said connector, said TPA component being selectively engagable with said housing in a preload position and in a final seated position, said TPA component being dimensioned such that in the preload position terminals are insertable into the terminal receiving cavities of the housing such that movement of the TPA component into the final seated position urges the locking fingers thereof against the diverging ramped surfaces of the divider wall and into locked engagement with a completely inserted terminal in the terminal receiving cavity.

13. A connector as in claim 12 wherein the ramped surfaces of the divider wall of the housing face the rearward end of the housing, and wherein the TPA component is insertable in and engagable with the rearward end of said housing.

14. A connector as in claim 12 wherein the terminal engaging fingers of the TPA component define secondary latches and wherein the housing comprises primary terminal engaging latches cantilevered therefrom and extending into each respective terminal receiving cavity for lockingly engaging a terminal inserted therein.

15. A connector as in claim 12 wherein the TPA component includes a plurality of deflectable housing engaging latches, each said housing engaging latch including first locking means for locking the TPA component in the preload position on the housing and a second locking means for locking the TPA component in the final seated position on the housing.

16. A connector as in claim 15 wherein the housing engaging latches of the TPA component are dimensioned to extend beyond the rearward end of the housing in the final seated position of the TPA component therein, such that the latches can be deflected for removing the TPA component from the final seated position in the housing.

17. An electrical connector for mounting to a panel, said panel having opposed first and second surfaces and at least one edge, a generally rectangular mounting cutout extending into the edge for receiving the connector, said mounting cutout being defined by top and bottom edge regions extending generally orthogonally from said edge of said panel and a side edge region extending generally parallel to the edge of the panel, a locking aperture being formed in the panel generally adjacent to the side edge region of the mounting cutout therein, said connector comprising:

a unitarily molded housing of generally rectangular cross-sectional configuration and including a body having a forward mating end, a rearward end, opposed generally parallel top and bottom walls extending between the forward and rearward ends and opposed generally parallel first and second side walls extending between the top and bottom walls, a plurality of terminal receiving cavities extending between the forward and rearward ends of the body, each said terminal receiving cavity being separated from at least one other terminal receiving cavity by a divider wall having a rearwardly facing pair of ramped surfaces diverging away from one another and toward the respective terminal receiving cavities adjacent said divider wall, said housing further including a plurality of spaced apart generally coplanar mounting walls extending outwardly from said body at locations intermediate the opposed forward and rearward ends, resiliently deflectable centering beams cantilevered from portions of the respective top, bottom and first side walls generally adjacent the rearward end of the body and extending toward the forward end, portions of said top and bottom centering beams being spaced from the body for slidably engaging the top and bottom edge regions of the mounting cutout in the panel; top, bottom and first side panel engaging walls disposed in a common plane spaced from and parallel to the plane of the mounting walls for engaging the second surface of the panel, the first side panel engaging wall including a latch extending forwardly and dimensioned for engaging the locking aperture in the panel; and a TPA component dimensioned for slidable insertion into the rearward end of the body of the housing and having deflectable housing engaging means for selectively engaging the housing in a preload position and in a final seated position, the TPA component including forwardly extending deflectable locking fingers disposed in spaced relationship to one another such that in the preload position the locking fingers are aligned with the ramped surfaces of the divider wall and are generally adjacent the respective terminal receiving cavities and such that in the final seated position of the TPA component the locking fingers are urged by the ramped surfaces of the divider wall into the terminal receiving cavity for locking engaging a terminal therein, whereby the connector enables float and self-alignment of the housing relative to the panel and whereby the TPA component positively locks terminals in a selected position in the housing.

* * * * *